US005111251A

United States Patent [19]

Uno et al.

[11] Patent Number: 5,111,251

[45] Date of Patent: May 5, 1992

[54] APPARATUS FOR CLEANING PHOTOCONDUCTIVE BELT

[75] Inventors: Mugijirou Uno, Isehara; Kazuhiro Yuasa, Zama, both of Japan

[73] Assignee: Ricoh Company, Ltd., Tokyo, Japan

[21] Appl. No.: 610,937

[22] Filed: Nov. 9, 1990

[30] Foreign Application Priority Data

Nov. 15, 1989 [JP] Japan ..... 1-294863

[51] Int. Cl.[5] ..... G03G 21/00

[52] U.S. Cl. ..... 355/297; 355/299; 355/307

[58] Field of Search ..... 355/296, 297, 299, 301, 355/302; 118/652; 15/256.51, 256.52, 256.53

[56] References Cited

U.S. PATENT DOCUMENTS

| | | | |
|---|---|---|---|
| 3,847,480 | 11/1974 | Fisher | 355/297 |
| 3,947,108 | 3/1976 | Thett et al. | 355/297 |
| 4,089,683 | 5/1978 | Knieser | 355/297 X |
| 4,140,389 | 2/1979 | Franke et al. | 355/297 |
| 4,339,195 | 7/1982 | Gabelman | 355/301 X |
| 4,364,660 | 12/1982 | Oda | 355/297 |

FOREIGN PATENT DOCUMENTS

| | | | |
|---|---|---|---|
| 56-88163 | 7/1981 | Japan | 355/297 |
| 60-168183 | 8/1985 | Japan | 355/297 |

*Primary Examiner*—Fred L. Braun

*Attorney, Agent, or Firm*—Oblon, Spivak, McClelland, Maier & Neustadt, P.C.

[57] ABSTRACT

A cleaning apparatus for cleaning a photoconductive belt of a seamless type which is used within a recording system for transferring a latent image of information to be recorded to a recording paper, the photoconductive belt being rotated along a rotation path by a plurality of supporting rollers. The cleaning apparatus includes a blade part provided at a first position along the rotation path of the photoconductive belt for removing a residual toner from the photoconductive belt, a brush part provided at a second position upstream of the first position along the rotation path of the photoconductive belt, the brush part having a pile material coming in contact with a surface of the photoconductive belt, and a scraper part for cleaning the brush part by removing a remaining toner from the pile material of the brush part. It is thus possible to keep the photoconductive belt clean for a long duration of the use in the recording system, without causing a cleaning problem. In one embodiment, the blade part includes a plurality of blades which are rotatably mounted on a rotary member and each blade is sequentially moved into contact with the photoconductive belt after a predetermined number of revolutions of the belt is reached.

3 Claims, 5 Drawing Sheets

APPARATUS FOR CLEANING PHOTOCONDUCTIVE BELT

BACKGROUND OF THE INVENTION

The present invention generally relates to cleaning apparatus, and more particularly to a cleaning apparatus which cleans a photoconductive belt used in an electrophotographic recording system such as a photocopier, a printer, a facsimile or the like.

A conventional recording system having a construction as shown in FIG. 1, generally has a photoconductive belt 20 including a photoconductive surface, a plurality of supporting rollers 21 for supporting and driving the photoconductive belt 20, a charging part 22, a toner developer 23, an image transfer part 24, a charge removal lamp 25, a belt cleaning apparatus 26, and a pair of fixing rollers 27. FIG. 2 shows in greater detail a construction of this conventional belt cleaning apparatus of the type as shown in FIG. 1. In FIG. 2, the conventional belt cleaning apparatus generally has a toner container 28 for storing unused toner from the photoconductive belt 20, a supporting member 29 having an oscillating movement due to a force applied by a spring 30 to the supporting member 29, a cleaning blade 31 being secured to the supporting member 29 and brought in contact with a surface of the photoconductive belt 20, a rotatable toner collecting member 32, a fixed toner collecting blade 33 coaxially supported with the rotatable toner collecting member 32, and a toner 34.

In FIGS. 1 and 2, the photoconductive belt 20 is rotated anticlockwise while being supported by the supporting rollers 21 during operation of the recording system. The photoconductive belt 20 is electrostatically charged by the charger 22, and the photoconductive belt 20 is exposed to light from a light source at an exposure position C, as indicated in FIG. 1, to form a latent image of recording information on a surface of the photoconductive belt 20 at this position. This latent image formed on the photoconductive belt surface is then developed with toner by the toner developer 23, and the image is transferred to a recording paper by the image transfer part 24. And, the image on the recording paper is fixed by the fixing rollers 27, thereby carrying out an image recording by the recording system. After the image transfer is performed by the image transfer part 24, a residual toner which has been unused for image recording still remains on the photoconductive belt surface, which is removed by the cleaning blade 31 of the belt cleaning apparatus 26. And, the residual toner is accumulated within the toner container 28, and the residual toner entering the toner container 28 is conventionally collected only by means of the rotatable toner collecting member 32 and the toner collecting blade 33 secured onto the toner collecting member 32 so that the residual toner is collected in the toner container 28. In this manner, the photoconductive belt 20 of the recording system is cleaned by removing the residual toner by the cleaning apparatus as described above.

However., when the recording system is used continuously for a long period of time, the toner, paper chips powder are gradually accumulated in a space between the photoconductive belt 20 and the cleaning blade 31, and in some cases a few laminations S, as shown in FIG. 3, may be produced in the space, and in the other cases the cleaning blade 31 which usually has a planar shape may partially be broken. Such laminations S and a broken part of the cleaning blade 31 may often cause a cleaning problem. Due to the laminations S, the cleaning blade 31 may slightly be lifted undesirably. The laminations S themselves may partially be broken because they are very brittle, a partial opening may be formed in the laminations S. Due to such openings of the laminations S, or the broken part of the cleaning blade 31, a portion P of the residual toner, as shown in FIG. 3, sometimes remains on the surface of the photoconductive belt 20 without being removed by the belt cleaning apparatus 26, thereby causing a problem such as a recorded paper showing a defective image including undesired vertical stripes appearing on the recorded paper.

SUMMARY OF THE INVENTION

Accordingly, it is a general object of the present invention to provide an improved cleaning apparatus for cleaning a photoconductive belt, in which the above described problems are eliminated.

Another and more specific object of the present invention is to provide a cleaning apparatus for cleaning a photoconductive belt of a seamless type which is used within a recording system for transferring a latent image of information to be recorded to a recording paper, the photoconductive belt being rotated along a rotation path by a plurality of supporting rollers, the cleaning apparatus comprising, a blade part provided at a first position along the rotation path of the photoconductive belt for removing a residual toner from the photoconductive belt, a brush part provided at a second position upstream of the first position along the rotation path of the photoconductive belt, the brush part having a pile material coming in contact with a surface of the photoconductive belt, and a scraper part for cleaning the brush part by removing a remaining toner from the pile material of the brush part. According to the present invention, it is possible to clean the photoconductive belt stably and safely for a long-standing duration of service without causing a cleaning problem, by means of the scraping means for cleaning the cleaning brush, by means of the cleaning part slidable along a photoconductive belt width, or by means of the rotary member on which a plurality of changeable blade edges are supported, thereby increasing the quality of image being formed on a recording paper.

Other objects and further features of the present invention will be apparatus from the following detailed description when read in conjunction with the accompanying drawings.

DESCRIPTION OF THE PREFERRED EMBODIMENTS

Figure 1:
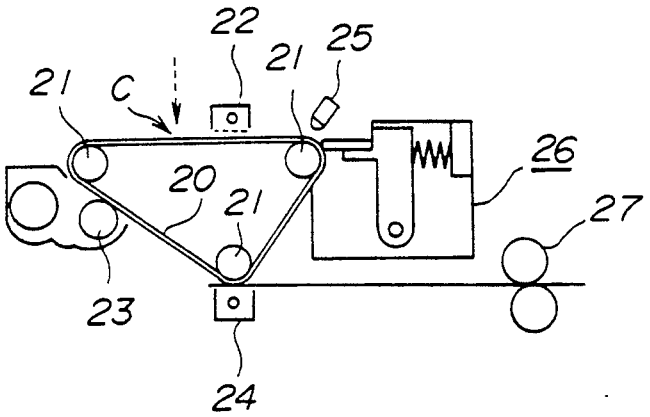
FIG. 1 PRIOR ART
FIG. 1 is a cross-sectional view which shows the construction of a conventional recording system in which a conventional cleaning apparatus is provided.
Figure 2:
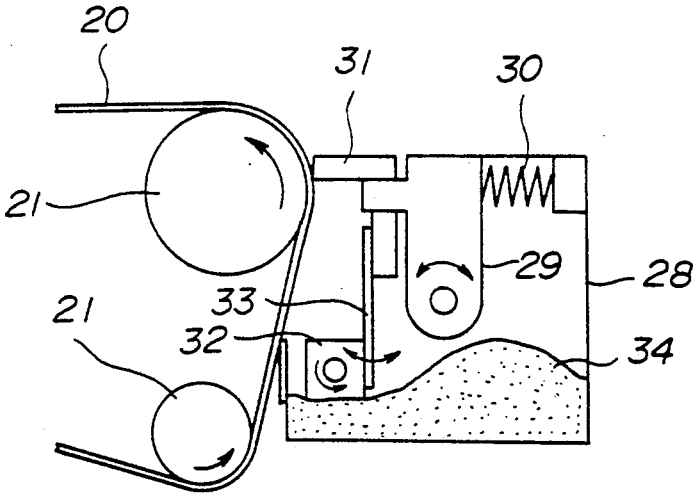
FIG. 2 PRIOR ART
FIG. 2 is an enlarged cross-sectional view which shows the construction of the conventional cleaning apparatus.
Figure 3:
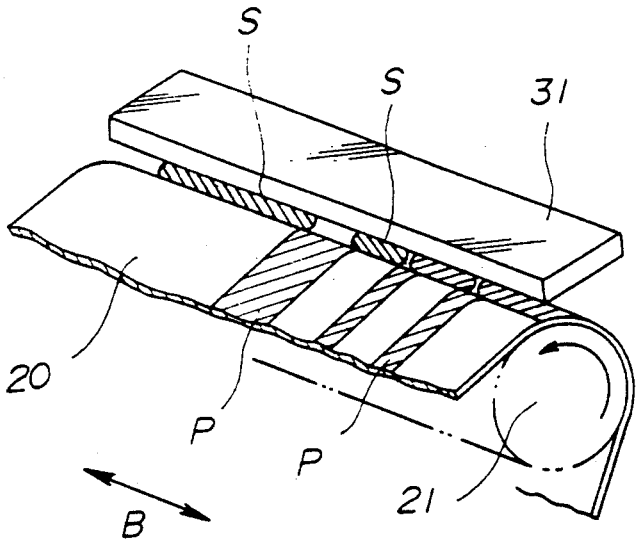
FIG. 3 PRIOR ART
FIG. 3 is a perspective view of the photoconductive belt for explaining a lamination of toner and paper chip between the photoconductive belt and the cleaning blade.
Figure 4:
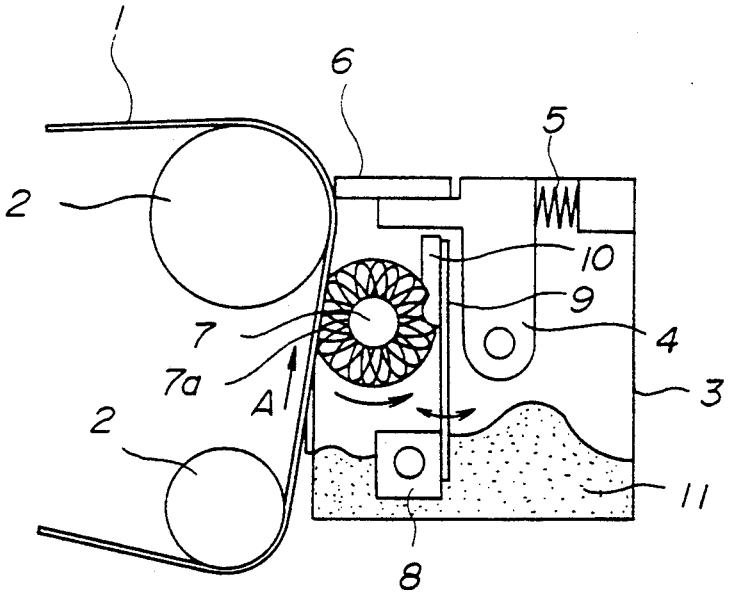
FIG. 4 is a cross-sectional view which shows the construction of an embodiment of a cleaning apparatus according to the present invention.

First a description will be given of the construction of a first embodiment of a belt cleaning apparatus for cleaning a photoconductive belt according to the present invention, which may be applied to an electrophotographic recording system, with reference to FIG. 4. As shown in FIG. 4, this belt cleaning apparatus generally has a seamless photoconductive belt 1, a plurality of supporting rollers 2 for driving the seamless photoconductive belt 1, a toner container 3 for collecting an unused toner 11, a reversible supporting member 4 which moves in an oscillating manner due to a force applied by a spring 5 to the supporting member 4, a cleaning blade 6 which is supported on the supporting member 4 and comes in contact with a surface of the photoconductive belt 1, a cleaning brush 7 having a looped pile material 7a which is provided at a position upstream of the cleaning blade 6 along a rotation path of the photoconductive belt 1, as indicated by an arrow A in FIG. 4, in which the photoconductive belt 20 rotates counterclockwise, a toner collecting member 8, a toner collecting blade 9 which is coaxially supported with the toner collecting member 8, a scraper 10 which is supported on the toner collecting blade 9 at an upper portion thereof and comes in contact with the cleaning brush 7 for removing a remaining toner from the cleaning brush 7, and a collected toner 11 within the toner container 3.

In FIG. 4, a residual substance such as toner, paper chips or paper powder which still remains on a photoconductive belt surface after a latent image on the photoconductive belt 1 is transferred to a recording paper by an image transfer part of the recording system is first removed from the photoconductive belt 1 by the cleaning brush 7, and such residual toner is stored in the toner container 3. The cleaning brush 7 is, as shown in FIG. 4, provided at a second position upstream of the cleaning blade 6 along the rotation path of the photoconductive belt 1. The cleaning brush 7 is rotated anticlockwise by a suitable driving means, at a speed different from the rotation speed of the photoconductive belt 1. Further, the residual substance still remaining on the photoconductive belt 1 is next removed by the cleaning blade 6, and such residual substance is stored in the toner container 3. Residual substance sticking to the cleaning brush 7 is removed by the scraper 10, and such residual substance drops down on the toner container 3. The residual toner within the toner container 3 is collected by means of the rotatable toner collecting member 8 and the toner collecting blade 9 secured onto the toner collecting member 8 so that the residual toner is collected in the toner container 3 in a manner similar to that of the conventional apparatus as described above.

Figure 5:
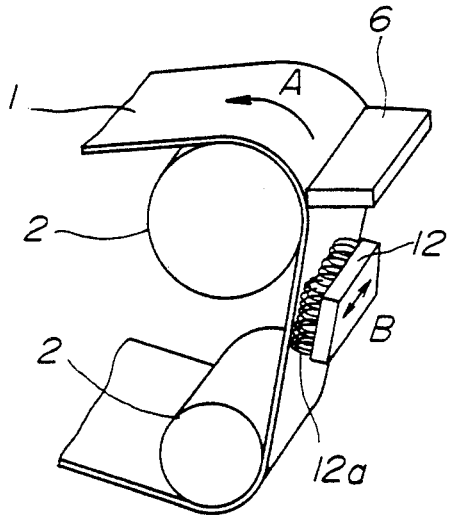
FIG. 5 is a perspective view which shows the construction of an embodiment of the cleaning apparatus.

FIG. 5 shows the construction of a second embodiment of a cleaning apparatus for cleaning a photoconductive belt, according to the present invention. As shown in FIG. 5, a slidable cleaning part comprising a cleaning plate 12 which has a looped pile material 12a on its surface is located at a position corresponding to that of the cleaning brush 7 as shown in FIG. 4, so that the looped pile material 12a comes in contact with the photoconductive belt surface. This cleaning part 12 is arranged slidable along the photoconductive belt surface in a direction of photoconductive belt width, as indicated by an arrow B in FIG. 5, which is parallel to the axial direction of the supporting rollers 2 shown in FIG. 5.

Figure 6:
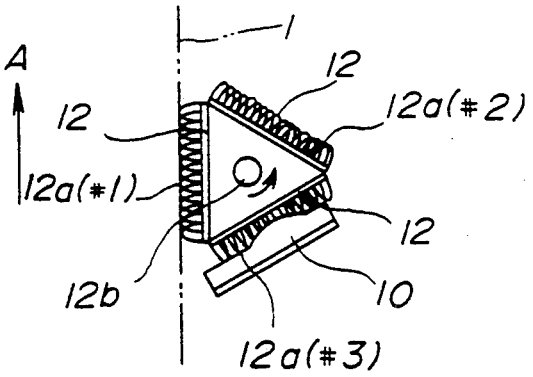
FIG. 6 is a side view which shows the construction of an embodiment of a cleaning part according to the present invention.

FIG. 6 is a side view showing the construction of another example of the cleaning part according to the present invention. In FIG. 6, there is provided a rotatable cleaning part in place of the cleaning brush 7 as shown in FIG. 4. This rotatable cleaning part may be constructed in a triangular form or in a polygonal form when viewed as a side elevation. This rotatable cleaning part has a plurality of cleaning plates 12 each having a looped pile material 12a which is provided on each surface of the cleaning plates 12. The rotatable cleaning part is rotatably supported on a shaft 12b extending along a direction parallel to the axial direction of the supporting rollers 2, and this rotatable cleaning part is rotated around the shaft 12b to bring one looped pile material 12a on the cleaning plate 12 into contact with the photoconductive belt surface. The rotation of the rotatable cleaning part is made after a prescribed duration of time of using the looped pile material 12a (#1), and a next rotation of the rotatable cleaning part is performed to locate another looped pile material 12a (#2) in contact with the photoconductive belt surface for cleaning the photoconductive belt. After a next prescribed duration of time of using the looped pile material 12a (#2), the rotatable cleaning part is again rotated around the shaft 12b to locate still another looped pile material 12a (#3) in contact with the photoconductive belt surface. In addition at a side portion of the above described rotatable cleaning part, a scraper 10 is provided in contact with the looped pile material 12a (#3) for removing a remaining toner from the looped pile material on the cleaning plate 12 so that all the looped pile material 12a can be kept clean. Therefore, it is possible to ensure a longer service life of the rotatable cleaning part according to the present invention.

Figure 7:
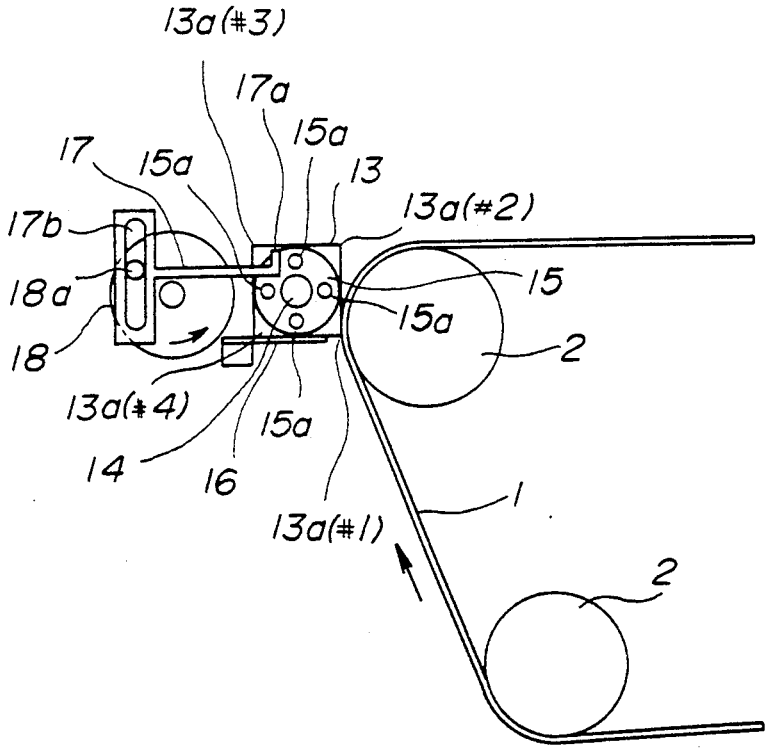
FIG. 7 is a cross-sectional view which shows the construction of an embodiment of a belt cleaning apparatus according to the present invention.

FIG. 7 shows the construction of another embodiment of the cleaning apparatus for cleaning the photoconductive belt according to the present invention. As shown in FIG. 7, this cleaning apparatus comprises a cleaning blade 13 having a plurality of cleaning edges 13a at its peripheral 5 portions (which may be arranged in a polygonal manner, and in FIG. 7, for example, arranged in to a rectangular shape), a drive shaft 14 on which the cleaning blade 13 is rotatably supported, a rotor 15 which secured onto a side portion of the drive shaft 14 and has a plurality of pins 15a arranged in a prescribed manner in accordance with that of the cleaning blade edges 13a, a stopper 16 having a leaf spring which is provided in contact with one side of the cleaning blade 13 to locate the cleaning blade 13 around the drive shaft 14, an operation member 17 having an operating part 17a at one end thereof, which come into contact with one of the pins 15a of the rotor 15, the operation member 17 further having a slot 17b at the other end, and a driving motor 18 having an operation pin 18a which is provided at a position deviated from its central axis. The operation pin 18a of the driving motor 18 is connected with the slot 17b of the operation member 17 so that the operation member 17 is moved in an oscillating manner.

In FIG. 7, a first blade edge 13a of the cleaning blade 13, which is located at a lower right corner thereof (as indicated by a reference symbol 13*a* (#1) in FIG. 7), is brought in contact with the surface of the photoconductive belt 1 to remove a residual substance from the photoconductive belt surface, or perform a cleaning procedure. After this first blade edge 13*a* cleans the photoconductive belt 1 for a prescribed period of time or for a prescribed number of revolutions of the photoconductive belt 1 around the supporting rollers 2, the driving motor 18 is rotated anticlockwise by a suitable control circuit (not shown), thereby allowing the operating pin 18*a* to press an internal side wall of the slot 17*b* of the operation member 17 in a direction toward the right as shown in FIG. 7 so that the operation member 17 to be moved to push the pin 15*a* of the rotor 15 toward the right via the operating part 17*a*. This allows the rotor 15 to rotate around the shaft 14 and the cleaning blade 13 to be rotated clockwise, thereby bringing a second blade edge 13*a* (#2) of the cleaning blade 13 into contact with the surface of the photoconductive belt 13 to perform a cleaning of the photoconductive belt 13. At this instant, the stopper 16 is temporarily curved downward, allowing the subsequent blade edge 13*a* of the cleaning blade 13 is next brought in contact with the photoconductive belt surface due to a cooperative action of the operation member 17 and the stopper 16 to locate the cleaning blade 13 at the following position thereof.

Although the above described timing of rotation of the cleaning blade 13 is predetermined, a conceivable method of controlling the rotation timing of the cleaning blade 13 is, for example, to count the number of revolutions of the photoconductive belt 1 by means of a sensor (not shown) which is turned on and off each time it senses a home position of the photoconductive belt 1 during rotating operation, and to control operation of driving motor 18 so as to have one complete revolution when the counted number of revolutions of the photoconductive belt 1 reaches a prescribed level which may be, for example, 15000 revolutions of the photoconductive belt 1. And, there is another method that can be used for the same purpose. In this method, the number of detections by an ejection paper sensor which senses a position of recording paper ejected out of the recording system, or the number of communication calls being transmitted or received is counted, and the driving motor 18 is driven when a predetermined number thereof is reached.

The number of the blade edges 13*a* which are provided on a surface of the cleaning blade 13 is not limited to that of the embodiment shown in FIG. 7. This cleaning blade 13 may be modified to have three blade edges which are arranged in a triangular form, or it may be modified to have six blade edges which are arranged in a hexagonal form.

As described above, changing the blade edge 13*a* which is in contact with the photoconductive belt surface into another one by rotating the cleaning blade 13 around the rotation shaft at predetermined intervals, will allow a stable operation of cleaning of the photoconductive belt by the cleaning apparatus for a long-standing period of time, without causing frequent parts change and time-consuming parts change operations. Therefore, the running cost of the recording system equipped with the cleaning apparatus according to the present invention can be reduced.

According to the present invention, it is possible to perform stably and safely a cleaning of the photoconductive belt, even when the recording system has been used for a long-standing period of time, by the provision of a cleaning brush, a movable cleaning part, and a plurality of removable blade edges, in addition to the provision of the cleaning blade, which are brought in contact with the photoconductive belt. And, it is therefore possible to provide a cleaning apparatus which will increase the quality of image recorded on a recording paper by the recording system.

Further, the present invention is not limited to these embodiments, and variations and modifications may be made without departing from the scope of the present invention.

What is claimed is:

1. A cleaning apparatus for cleaning a photoconductive belt of a seamless type which is used within a recording system for transferring a latent image of information to be recorded onto a recording paper, the photoconductive belt being rotated along a rotation path by a plurality of supporting rollers, said cleaning apparatus comprising:

blade means provided at a first position along the rotation path of the photoconductive belt for removing a residual toner from the photoconductive belt;

brush means provided at a second position upstream of the first position along the rotation path of the photoconductive belt, the brush means having a pile material coming in contact with a surface of the photoconductive belt;

scraper means for cleaning the brush means by removing a remaining toner from the pile material of the brush means;

said blade means including a rotary part on which a plurality of blade edges are supported, the rotary part being rotatable around a shaft extending in a direction parallel to the axial direction of the supporting rollers;

a stopper part for locating the rotary part at a third position along the rotation path where one of the plurality of blade edges comes in contact with a photoconductive belt surface; and a drive part for rotating the rotary part around the shaft, responsive to a control signal which is supplied by said recording system to said drive part when a prescribed number of revolutions of the photoconductive belt is reached, so that one of the plurality of blade edges is selectively brought in contact with the photoconductive belt surface.

2. The cleaning apparatus as claimed in claim 1, wherein the rotary part includes the shaft and a polygonal-shaped plate having peripheral portions at which the plurality of blade edges are supported, respectively, the rotary part being rotated around the shaft by the drive part, so that one of the plurality of blade edges is selectively brought in contact with the photoconductive belt surface for removing the residual toner from the photoconductive belt.

3. The cleaning apparatus as claimed in claim 1, wherein the drive part includes a driving motor and an operation part, the driving motor being driven in response to the control signal supplied by the recording system when the prescribed number of revolutions of the photoconductive belt is reached, to move the operation part to a position where the rotary part is positioned at the third position by a portion of the operation part so that one of the plurality of blade edges is selectively brought in contact with the photoconductive belt surface.

* * * * *